United States Patent [19]

Bucher

[11] Patent Number: 4,876,753

[45] Date of Patent: Oct. 31, 1989

[54] AIR TURBULENCE MASSAGE DEVICE

[75] Inventor: Heinz Bucher, Rottweil, Fed. Rep. of Germany

[73] Assignee: Metronic Electronic GmbH, Rottweil, Fed. Rep. of Germany

[21] Appl. No.: 271,205

[22] Filed: Nov. 14, 1988

[30] Foreign Application Priority Data

Nov. 12, 1987 [DE] Fed. Rep. of Germany ..... 3738363

[51] Int. Cl.[4] ..... A61H 33/02

[52] U.S. Cl. ..... 4/542; 4/541; 4/543; 128/66; 261/DIG. 75

[58] Field of Search ..... 4/541-544, 4/546, 491, 492, 496; 128/66; 261/121.1, DIG. 75

[56] References Cited

U.S. PATENT DOCUMENTS

| | | | |
|---|---|---|---|
| 4,008,498 | 2/1977 | Thomas | 4/543 |
| 4,166,296 | 9/1979 | Darrah et al. | 4/543 |
| 4,409,693 | 10/1983 | Baumann | 4/543 |
| 4,592,100 | 6/1986 | Robertson et al. | 4/542 X |
| 4,637,080 | 1/1987 | Hutchinson | 4/544 X |
| 4,672,692 | 6/1987 | Savage | 4/543 |
| 4,742,584 | 5/1988 | Abe | 4/542 |
| 4,780,917 | 11/1988 | Hancock | 4/542 |

FOREIGN PATENT DOCUMENTS

| | | |
|---|---|---|
| 2334129 | 1/1975 | Fed. Rep. of Germany . |
| 2513261 | 1/1976 | Fed. Rep. of Germany . |
| 2517365 | 10/1976 | Fed. Rep. of Germany . |
| 2531666 | 5/1977 | Fed. Rep. of Germany . |
| 2619603 | 5/1977 | Fed. Rep. of Germany . |
| 3209635 | 3/1982 | Fed. Rep. of Germany . |
| 2931238 | 12/1982 | Fed. Rep. of Germany . |
| 3447161 | 7/1986 | Fed. Rep. of Germany . |

*Primary Examiner*—Henry K. Artis

*Attorney, Agent, or Firm*—Thomas W. Speckman; Douglas H. Pauley

[57] ABSTRACT

This invention relates to an air turbulence massage device having a control device with a blower unit and a turbulence matting which can be placed in a bathtub. The turbulence matting can be connected with the blower unit outlet by means of an air tube. The turbulence intensity, using a preset program, can be adjusted and changed between a lower and an upper value by varying the rotational speed of the blower unit. To achieve siultaneous switching times with the turbulence process, this invention provides that the lower value is preset as a minimum pressure value which is enough to overcome a counter-pressure predetermined by a normal water level in the bathtub. The upper value is preferably preset as an adjustable maximum pressure value. At predetermined time intervals, the turbulence intensity can be abruptly switched between the predetermined minimum pressure value and the predetermined maximum pressure value and/or can be changed at predetermined time intervals which alternately increase and decrease the turbulence intensity.

20 Claims, 1 Drawing Sheet

AIR TURBULENCE MASSAGE DEVICE

BACKGROUND OF THE INVENTION

1. Field of the Invention

This invention relates to an air turbulence massage device having a control device which accommodates a blower unit and a turbulence matting. The turbulence matting can be placed in a bathtub and can be connected with a blower unit outlet by means of an air tube. The intensity of turbulence can be selected by means of a preset program which changes the rotational speed of the blower unit between a lower and an upper value.

2. Description of the Prior Art

An air turbulence massage device of a similar type is known from German Patent Publication No. DE-OS 23 34 129. In such known air turbulence massage device, the blower unit is first switched on at half rotational speed. Then, the blower unit is switched on at full rotational speed. Finally, after a specified time, the blower unit is abruptly switched off and started again at full or half rotational speed. Such program, also known as interval massage, switches abruptly from a lower to an upper value of turbulence intensity. The program allows the air turbulence massage device to switch on again after a disconnection interval. This type of change in turbulence intensity has one disadvantage in that the blower unit switching times are not simultaneous with the beginning and the end of the turbulence process. turbulence matting in the bathtub operates under a specific static head determined by the water level, the turbulence process has a delayed start and also prematurely ends when the blower unit is turned off. Thus, the actual time of the turbulence process differs considerably from the predetermined switching times of the blower unit. The same also applies if the switching times for the blower unit are preselected by means of a manually set time.

SUMMARY OF THE INVENTION

It is one object of this invention to provide an air turbulence massage device in which the predetermined switching times, set manually or by means of a program, correspond to the activated times of the turbulence process.

According to one embodiment of this invention, a lower value of the turbulence intensity is set at a minimum value which suffices to overcome a counter-pressure of static head predetermined by a normal water level in a bathtub. An upper value can preferably be preset as an adjustable maximum value. At preset time intervals, the turbulence intensity can be abruptly switched between the predetermined minimum value and the predetermined maximum value and/or the turbulence intensity can be changed, at predetermined time intervals, to alternately increase and decrease.

Since the minimum value of the turbulence intensity approximately corresponds to the counter-pressure of the water level in the bathtub, the turbulence process starts after a slight increase of turbulence intensity. The distorting time intervals from switching the blower unit on to reaching a turbulence intensity which overcomes the counter-pressure, as well as distorting time intervals from falling short of such turbulence intensity to reducing the turbulence intensity to zero are eliminated. The switching times also correspond to the activated times of the turbulence process.

According to one preferred embodiment, the minimum value and/or the maximum value can be preselected and preset either manually or by means of the program. Thus the start time of the turbulence process and the maximum turbulence intensity can be individually adjusted to given conditions.

An interval operation can be achieved since the maximum value can be alternately adjusted for an impulse time which is preset manually or by means of the program. The minimum value can be adjusted for an interval time which can be predetermined manually and/or by means of the program. Thus synchronization of the switching times and the turbulence process is ensured. In one modification of the interval operation, the time intervals for the alternating increase and decrease of the turbulence intensity can be predetermined and changed manually and/or by means of the program. The increase and decrease of the turbulence intensity can thus be lengthened to longer time intervals. In one embodiment, the time change of the turbulence intensity is sinusoidal.

BRIEF DESCRIPTION OF THE DRAWINGS

This invention will be further illustrated by two pressure/time graphs shown in the drawings wherein.

DESCRIPTION OF THE PREFERRED EMBODIMENTS

Figure 1:
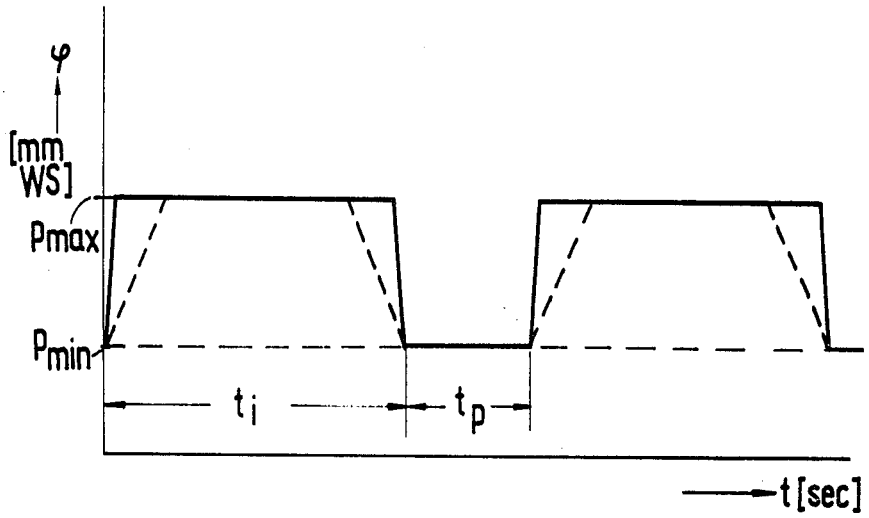
FIG. 1 shows a pressure v. time graph of the air turbulence massage device for interval operation.

FIG. 1 shows that the blower unit of the air turbulence massage device is not switched of during operation. The blower unit remains switched on and produces a turbulence intensity which approximately corresponds to the counter-pressure of a water column, from the normal level, for example 350 mm, of water in a bathtub, acting on the turbulence matting. The pressure value of pressurized air in communication with the turbulence matting has a minimum pressure value ($P_{min}$) during the programmed turbulence process. The pressure value does not fall below the minimum pressure value ($P_{min}$) during operation of the air turbulence massage device. The minimum pressure value ($P_{min}$) can be adjusted by varying the rotational speed of the blower unit. A manual adjustment of the blower unit can be set according to the water level in the bathtub. The impulse time ($t_i$) and the interval time ($t_p$) are predetermined by the program. Such times can also be manually preselected and have manually adjustable time elements. The impulse time ($t_i$) and the interval time ($t_p$) can be independently preselected or preset so that an impulse/interval ratio can be adjusted. The impulse time ($t_i$) determines the duration of the turbulence process, and the interval time ($t_p$) determines a resting or pause interval between massage periods. Since the turbulence process takes place during a slight increase in the pressure, the turbulence times approximately correspond to the impulse times ($t_i$). The pressure increase and pressure decrease shown in FIG. 1 are abrupt within a relatively short time so that the end of the turbulence process coincides with switching off of the blower unit. FIG. 1 shows dashed lines which represent pressure increase and pressure decreases which can be extended over time. Thus, the switching times of the blower unit conform with the turbulence process and only the transition of the turbulence intensity changes from the minimum pressure value ($P_{min}$) to the maximum pressure value ($P_{max}$), and vice versa.

Figure 2:
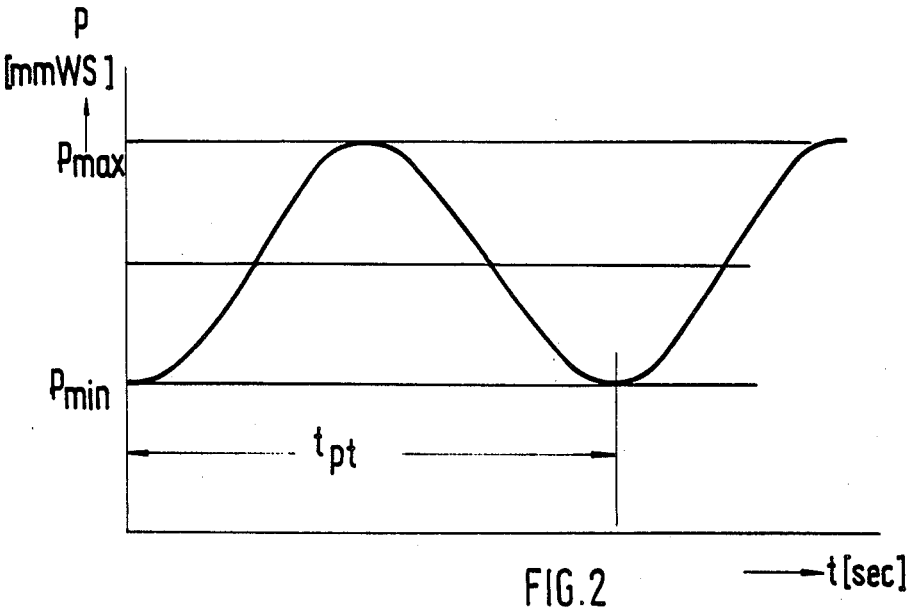
FIG. 2 shows a pressure v. time graph of the air turbulence massage device with sinusoidal pressure changes relative to time.

As shown in FIG. 2, the pressure change from the minimum pressure value ($P_{min}$) to the maximum pressure value ($P_{max}$), and vice versa, can take place in a sinusoidal function. The time interval ($t_{pt}$), which determines the period of the pressure change, can be preset. A manual preselection and/or a presetting of the time interval ($t_{pt}$) can be provided by the program.

Also, the maximum pressure value ($P_{max}$) can be preselected and/or preset manually and/or by means of the program. The maximum turbulence intensity can also be so adjusted.

I claim:

1. A turbulence process for an air turbulence massage device having a control device accommodating a blower unit and a turbulence matting which is positionable in a bathtub, the turbulence matting being connected with the blower unit outlet by means of an air tube, a turbulence intensity and a duration of a turbulence process is selected by preset program means, the turbulence intensity of the turbulence process is adjusted by varying a rotational speed of the blower unit between a lower and an upper value, and the duration of the turbulence process is changed by a connection duration of the blower unit, the turbulence process steps comprising:

(a) presetting the lower value as a minimum pressure value ($P_{min}$) which overcomes a counter-pressure from a static head of a water level in the bathtub;

(b) predetermining the upper value as a maximum pressure value ($P_{max}$);

(c) presetting at least one of the minimum pressure value ($P_{min}$) and the maximum pressure value ($P_{max}$) by at least one of manual means and the program means; and (d) during preselected time intervals ($t_i$,$t_p$) of the turbulence process, abruptly switching the turbulence intensity between at least one of: (1) the preset minimum pressure value ($P_{min}$) and the preselected maximum pressure value ($P_{max}$); and (2) predetermined time intervals ($t_{pt}$) to alternately increase and decrease the turbulence intensity.

2. A process for an air turbulence massage device in accordance with claim 1, wherein at least one of the minimum pressure value ($P_{min}$) and the maximum pressure value ($P_{max}$) can be preset by at least one of the manual means and the program means.

3. A process for an air turbulence massage device in accordance with claim 2, wherein for an interval program the maximum pressure value ($P_{max}$) is adjusted for an impulse time ($t_i$) preset by at least one of the manual means and the program means, and the minimum pressure value ($P_{min}$) can be adjusted for a pause time ($t_p$) which can be preset by at least one of the manual means and the program means.

4. A process for an air turbulence massage device in accordance with claim 3, wherein the time intervals ($t_{pt}$) for the alternate increase and decrease of the turbulence intensity are preset by at least one of the manual means and the program means.

5. A process for an air turbulence massage device in accordance with claim 4, wherein the turbulence intensity is sinusoidally changed with respect to time.

6. A process for an air turbulence massage device in accordance with claim 1, wherein for an interval program the maximum pressure value ($P_{max}$) is adjusted for an impulse time ($t_i$) preset by at least one of the manual means and the program means, and the minimum pressure value ($P_{min}$) can be adjusted for a pause time ($t_p$) which can be preset by at least one of the manual means and the program means.

7. A process for an air turbulence massage device in accordance with claim 2, wherein the time intervals ($t_{pt}$) for the alternate increase and decrease of the turbulence intensity are preset by at least one of the manual means and the program means.

8. A process for an air turbulence massage device in accordance with claim 7, wherein the turbulence intensity is sinusoidally changed with respect to time.

9. A process for an air turbulence massage device in accordance with claim 1, wherein the time intervals ($t_{pt}$) for the alternate increase and decrease of the turbulence intensity are preset by at least one of the manual means and the program means.

10. A process for an air turbulence massage device in accordance with claim 9, wherein the turbulence intensity is sinusoidally changed with respect to time.

11. An air turbulence massage device having a control device accommodating a blower unit and a turbulence matting which is positionable in a bathtub, said turbulence matting being connected with said blower unit outlet by means of an air tube, a turbulence intensity and a duration of turbulence selectable by means of a preset program, said turbulence intensity adjustable by a variable rotational speed of said blower unit operating between a lower and an upper value, and said duration of turbulence changeable by operating said blower unit, said air turbulence massage device comprising: presetting means for presetting said lower value as a minimum pressure value ($P_{min}$) which overcomes a counter-pressure from a static head of a water level in said bathtub, predetermining means for predetermining said upper value as a maximum pressure value ($P_{max}$), at least one of manual preset means and program means for presetting at least one of said minimum pressure value ($P_{min}$) and said maximum pressure value ($P_{max}$), and switching means for abruptly switching said turbulence intensity between at least one of: (1) said preset minimum pressure value ($P_{min}$) and said preselected maximum pressure value ($P_{max}$); and (2) predetermined time intervals ($t_{pt}$) to alternately increase and decrease said turbulence intensity.

12. An air turbulence massage device in accordance with claim 11, wherein at least one of said minimum pressure value ($P_{min}$) and said maximum pressure ($P_{max}$) is preset by at least one of said manual preset means and said program means.

13. An air turbulence massage device in accordance with claim 12, wherein at least one of said manual preset means and said program means are used to adjust said maximum pressure value ($P_{max}$) for an interval program having an impulse time ($t_i$) and at least one of said manual preset means and said program means are used to adjust said minimum pressure value ($P_{min}$) for a pause time ($t_p$)

14. An air turbulence massage device in accordance with claim 13, wherein at least one of said manual preset means and said program means are used to preset time intervals ($t_{pt}$) for alternately increasing and decreasing said turbulence intensity.

15. An air turbulence massage device in accordance with claim 14, wherein at least one of said manual preset means and said program means are used to sinusoidally change the turbulence intensity with respect to time.

16. An air turbulence massage device in accordance with claim 11, wherein at least one of said manual preset means and said program means are used to adjust said maximum pressure value ($P_{max}$) for an interval program having an impulse time ($t_i$) and at least one of said manual preset means and said program means are used to adjust said minimum pressure value ($P_{min}$) for a pause time ($t_p$)

17. An air turbulence massage device in accordance with claim 12, wherein at least one of said manual preset means and said program means are used to preset time intervals ($t_{pt}$) for alternately increasing and decreasing said turbulence intensity.

18. An air turbulence massage device in accordance with claim 17, wherein at least one of said manual preset means and said program means are used to sinusoidally change the turbulence intensity with respect to time.

19. An air turbulence massage device in accordance with claim 11, wherein at least one of said manual preset means and said program means are used to preset time intervals ($t_{pt}$) for alternately increasing and decreasing said turbulence intensity.

20. An air turbulence massage device in accordance with claim 19, wherein at least one of said manual preset means and said program means are used to sinusoidally change the turbulence intensity with respect to time.

* * * * *